US011189246B2

(12) United States Patent
Takazane et al.

(10) Patent No.: US 11,189,246 B2
(45) Date of Patent: Nov. 30, 2021

(54) DISPLAY CONTROL APPARATUS, DISPLAY APPARATUS, NON-TRANSITORY STORAGE MEDIUM, AND CONTROL METHOD

(71) Applicant: SHARP KABUSHIKI KAISHA, Sakai (JP)

(72) Inventors: Yohichi Takazane, Sakai (JP); Yuichi Sato, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/150,440

(22) Filed: Jan. 15, 2021

(65) Prior Publication Data

US 2021/0233494 A1 Jul. 29, 2021

(30) Foreign Application Priority Data

Jan. 23, 2020 (JP) ..... JP2020-009380

(51) Int. Cl.
*G09G 5/10* (2006.01)
*G09G 3/3233* (2016.01)

(52) U.S. Cl.
CPC ..... *G09G 5/10* (2013.01); *G09G 3/3233* (2013.01); *G09G 2320/064* (2013.01); *G09G 2360/141* (2013.01); *G09G 2360/144* (2013.01); *G09G 2360/145* (2013.01)

(58) Field of Classification Search
CPC .. G09G 5/10; G09G 3/3233; G09G 2360/145; G09G 2360/144; G09G 2360/141; G09G 2320/064; G09G 2370/08; G09G 2340/16; G09G 2340/0435; G09G 2320/0653
See application file for complete search history.

(56) References Cited

U.S. PATENT DOCUMENTS 8,803,925 B2 * 8/2014 Seo ..... G09G 3/342 345/690
10,991,320 B2 * 4/2021 Kim ..... G09G 3/36
2021/0183290 A1 * 6/2021 Sato ..... G09G 3/3233
2021/0201738 A1 * 7/2021 Song ..... G09G 3/20

FOREIGN PATENT DOCUMENTS

JP 2006333288 A 12/2006

* cited by examiner

*Primary Examiner* — Rodney Amadiz
(74) *Attorney, Agent, or Firm* — ScienBiziP, P.C.

(57) ABSTRACT

A display control apparatus comprises a host control unit configured to acquire or generate video image data of a video image to be displayed on the display panel; and a display control unit configured to output the video image data transferred from the host control unit to the display panel, the host control unit performing: determining a proper duty ratio of a duty ratio indicating a ratio of a light emission time of the video image to a display time of the video image such that as a frame rate of the video image increases, the ratio of the light emission time of the video image to the display time of the video image decreases; and controlling the display control unit to adjust the duty ratio such that the display panel emits light at the proper duty ratio.

8 Claims, 7 Drawing Sheets

| NAME OF APPLICATION PROGRAM | CATEGORY | LIGHT EMISSION MODE |
|---|---|---|
| 1st APPLICATION PROGRAM | GAME | PSEUDO-IMPULSE DRIVING (DUTY RATIO: 50%) |
| 2nd APPLICATION PROGRAM | PRODUCTIVITY | HOLD DRIVING |
| 3rd APPLICATION PROGRAM | NEWS | HOLD DRIVING |
| 4th APPLICATION PROGRAM | GAME | PSEUDO-IMPULSE DRIVING (DUTY RATIO: 70%) |
| ... | ... | ... |

DISPLAY CONTROL APPARATUS, DISPLAY APPARATUS, NON-TRANSITORY STORAGE MEDIUM, AND CONTROL METHOD

BACKGROUND

1. Field

An aspect of the present disclosure relates to a display control apparatus, a display apparatus including a display control apparatus, a non-transitory storage medium of a display control apparatus, and a control method.

2. Description of the Related Art

Current-driven organic electro luminance (EL) elements are widely used as electro-optic elements for forming pixels arranged in the form of a matrix. Organic EL displays using organic EL elements as pixels have features that it is possible to realize thin displays with large sizes capable of displaying vivid video images, and thus in recent year, active efforts have been made to develop organic EL displays using organic EL elements as pixels.

In particular, in many cases, a current-driven electro-optic element is provided together with a switch element such as a thin-film transistor (TFT) in each pixel to realize an active matrix type display apparatus in which electro-optic elements are controlled on a pixel-by-pixel basis. By configuring the display apparatus as the active matrix type, it becomes possible to display a video image with higher definition than a passive-type display apparatus can.

In display apparatuses of the active matrix type, a connection line is formed in a horizontal direction for each row, and a data line and a power line are formed in a vertical direction for each column. Each pixel includes an electro-optic element, a connection transistor, a driving transistor, and a capacitor. When a voltage is applied to a connection line, a connection transistor turns on, which causes a capacitor to be charged with a data voltage (a data signal) on the data line, and thus data is written. The data voltage charged in the capacitor causes a driving transistor to turn on, which causes a current to flow from a power line to an electro-optic element. Thus, light emission occurs in a pixel.

In the display apparatus of the active matrix type, moving images can be displayed by driving pixels arranged in the form of a matrix of the display apparatus with a data signal thereby causing the pixels to emit light. To display a moving image, for example, connection lines are scanned in the vertical direction. Each time the connection lines are completely scanned once in the vertical direction, a complete one frame of the moving image is formed. The scanning for forming one frame is performed at a specified frequency (specific frequency).

In the active matrix type display apparatus, to reduce a display blur and an after-image effect, it is generally known to perform pseudo-impulse driving on the display apparatus. In the pseudo-impulse driving, a non-light-emission period, during which the display apparatus does not perform light emission, is provided in each frame such that the non-light-emission period has a length equal to or larger than a particular value. Note that one frame period is defined as a period in which a video image is displayed on the display apparatus at a predetermined frame rate.

However, in the pseudo-impulse driving, the display illuminance of the display apparatus is lower than is obtained in the hold driving, which may result in a reduction in visibility. To handle the above situation, if it is tried to achieve as high a display illuminance in the pseudo-impulse driving as obtained in the hold driving, the result is an increase in power consumption of the display apparatus, and an increase in Load on the display apparatus, which may easily cause the display apparatus to be degraded with time. In contrast, in the hold driving, the display apparatus continuously performs light emission over one frame period.

As described above, the hold driving and the pseudo-impulse driving both have their own problems. As for a techniques for solving both the problems of the hold driving and the pseudo-impulse driving, for example, Japanese Unexamined Patent Application Publication No. 2006-333288 discloses a light emitting apparatus configured to generate two pieces of moving image data with different frame rates. More specifically, the light emitting apparatus disclosed in Japanese Unexamined Patent Application Publication No. 2006-333288 generates first moving image data to be displayed at a first frame rate and second moving image data to be displayed at a second frame rate, and outputs them. The light emitting apparatus emits light emitting elements at a light emission duty ratio selected according to the second frame rate.

SUMMARY

However, the technique disclosed in Japanese Unexamined Patent Application Publication No. 2006-333288 is for solving a display blur that occurs in the hold driving and a flicker problem that occurs in the pseudo-impulse driving. Therefore, the technique disclosed in Japanese Unexamined Patent Application Publication No. 2006-333288 does not provide a sufficient solution to problems regarding an increase in power consumption of the light emitting apparatus and a degradation of the light emitting apparatus with time, which occur in the pseudo-impulse driving.

In view of the above, one aspect of the present disclosure provides a technique for achieving, in a display apparatus, an improvement of display quality, a reduction in power consumption, and a reduction in degradation with time.

One aspect of the present disclosure provides a display control apparatus configured to control a display apparatus including a display panel, the display control apparatus including a host control unit configured to acquire or generate video image data of a video image to be displayed on the display panel, and a display control unit configured to output the video image data transferred from the host control unit to the display panel, the host control unit performing setting a proper duty ratio of a duty ratio indicating a ratio of a light emission time of the video image to a display time of the video image such that as a frame rate of the video image increases, the ratio of the light emission time of the video image to the display time of the video image decreases, and controlling the display control unit to adjust the duty ratio such that the display panel emits light at the proper duty ratio.

One aspect of the present disclosure provides a method of controlling a display control apparatus configured to control a display apparatus including a display panel, the display control apparatus including a host control unit configured to acquire or generate video image data of a video image to be displayed on the display panel, and a display control unit configured to output the video image data transferred from the host control unit to the display panel, the method including controlling the host control unit to adjust a proper duty ratio of a duty ratio indicating a ratio of a light emission time of the video image to a display time of the video image such that as a frame rate of the video image increases, the ratio of the light emission time of the video image to the display time of the video image decreases, and controlling the display control unit to adjust the duty ratio such that the display panel emits light at the proper duty ratio.

DESCRIPTION OF THE EMBODIMENTS

Figure 1:
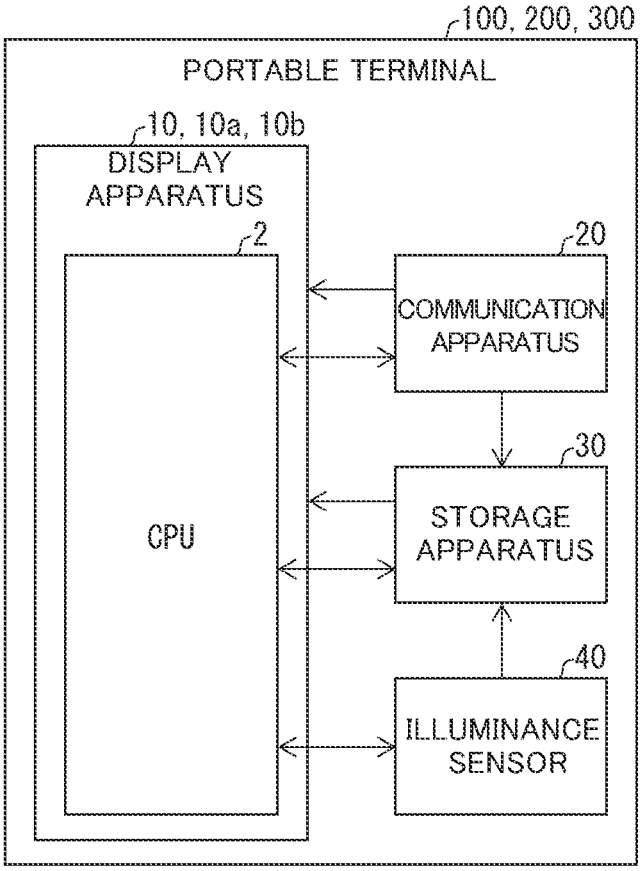
FIG. 1 is a block diagram illustrating an outline of a configuration of a portable terminal according to one of first to third embodiments of the present disclosure.

Embodiments for implementing the present disclosure are described below. For convenience of explanation, same reference numerals may be used to denote elements having same functions as those of elements previously described, and duplicated explanations thereof may be omitted.

First Embodiment

Outline of Configuration of Portable Terminal 100

Referring to FIG. 1, an outline of a configuration of a portable terminal 100 according to a first embodiment of the present disclosure is described. The portable terminal 100 is, for example, a smartphone, a tablet terminal, a wearable terminal, or a personal computer (PC). In the following description of the present embodiment, by way of example, a smartphone is taken as an example of the portable terminal 100. In a description performed later as to a portable terminals 200 and 300, a smartphone is also taken as an example. As shown in FIG. 1, the portable terminal 100 includes a display apparatus 10, a communication apparatus 20, and a storage apparatus 30.

Figure 2:
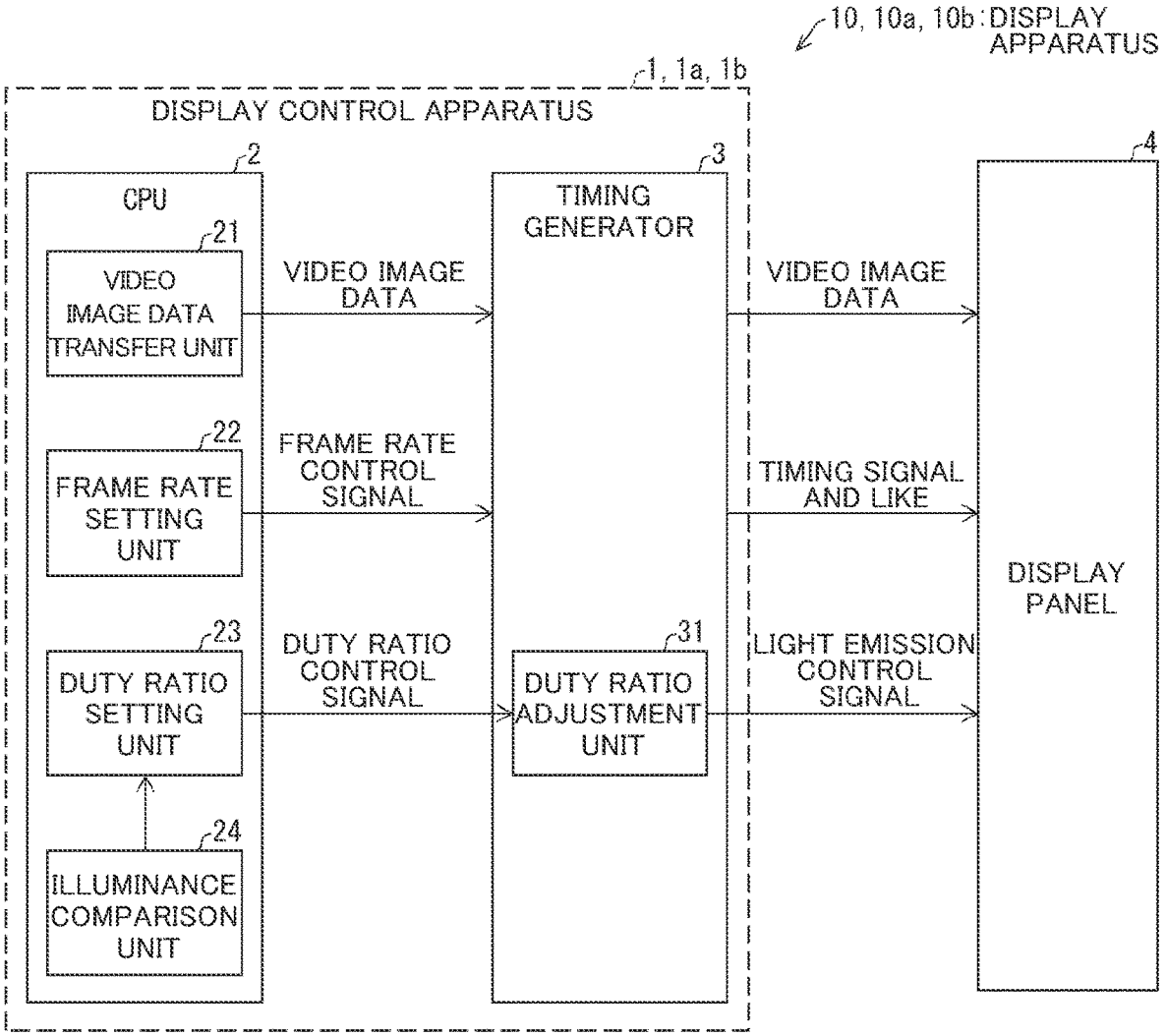
FIG. 2 is a block diagram illustrating an outline of a configuration of a display apparatus according to one of the first to third embodiments of the present disclosure.

The display apparatus 10 displays various video images on a display screen of the display panel 4 (see FIG. 2). The video images displayed on the display screen may include a game application image, a social networking service (SNS) image, a camera image, a TV image, and/or the like. The display apparatus 10 includes a built-in display control apparatus 1 (see FIG. 2) which includes a CPU (Central Processing Unit) 2. The CPU 2 is responsible for control of units on a host side of the display control apparatus 1 (for example, control of the portable terminal 100). That is, the CPU 2 centrally controls apparatuses and units in the portable terminal 100. The CPU 2 may be provided outside the display control apparatus 1 or outside the display apparatus 10. Details of the CPU 2 are described later.

The communication apparatus 20 has general functions for connecting to an external communication apparatus (not shown) via the Internet or the like to transmit and receive various data to and from the external communication apparatus. The storage apparatus 30 stores various programs and data for the portable terminal 100 to operate. The user is allowed to store various kinds of data and/or the like in the storage apparatus 30.

Outline of Configuration of Display Apparatus 10

Referring to FIG. 2, an outline of a configuration of the display apparatus 10 according to the first embodiment of the present disclosure is described. As shown in FIG. 2, the display apparatus 10 includes at least the display control apparatus 1 and the display panel 4.

Display Control Apparatus 1

The display control apparatus 1 is an apparatus enclosed by a broken line in FIG. 2, and is configured to centrally control apparatuses and units in the display apparatus 10. The display control apparatus 1 includes the CPU 2 and a timing generator 3. The CPU 2 is an example of the host control unit according to an aspect of the present disclosure, and the timing generator 3 is an example of the display control unit according to the aspect of the present disclosure.

The CPU 2 acquires video image data for displaying a video image on the display screen of the display panel 4. In the present embodiment and the embodiments described below, data representing a single frame of a moving image is used as an example of video image data. The CPU 2 also obtains a video image update flag (a time reference) indicating when the video image data is to be displayed on the display screen.

The video image data and the video image update flag are generated, for example, by an application program that is launched and executed in the display apparatus 10. For example, the video image data and the video image update flag may be included in data streaming or broadcast wave obtained via an Internet connection.

The portable terminal 100 may include a GPU (Graphics Processing Unit). The GPU performs computational processing to draw a video image such as a 3D graphic image. In a case where the portable terminal 100 has a GPU, the CPU 2 may obtain video image data and a video image update flag generated by the GPU. Alternatively, the CPU 2 may generate video image data and a video image update flag according to an instruction given by an application program or the like.

The CPU 2 performs control such that the acquired video image data is stored in a not-shown host memory. The host memory is a storage apparatus realized using a VRAM (Video Random Access Memory) or the like, and may be built in the CPU 2 or may be provided outside the CPU 2.

The CPU 2 includes a video image data transfer unit 21, a frame rate setting unit 22 and a duty ratio setting unit 23. When the CPU 2 acquires a video image data update flag, the video image data transfer unit 21 reads video image data from the host memory and transfers it to the timing generator 3. The format of the video image data transferred to the timing generator 3 is not particularly limited as long as the format allows the video image data to be displayed on the display screen of the display panel 4.

The video image data transfer unit 21 transfers video image data of an update video image to the timing generator 3 only when the video image is to be updated (in other words, only when a change occurs in the content of the video image). The transferring of the video image data is performed according to data communication specifications of the mobile devices such as MIPI (Mobile Industry Processor Interface). Note that the video image data transfer unit 21 transfers a synchronization signal together with the video image data to the timing generator 3.

When the video image data transfer unit 21 transmits the video image data to the timing generator 3, the transferring is performed at a predetermined frequency [Hz], in other words, at a predetermined frame rate. The predetermined frame rate is set by the frame rate setting unit 22. In response to receiving an instruction from the video frame rate setting unit 22, the video image data transfer unit 21 transfers the video image data to the timing generator 3 at the predetermined frame rate.

The frame rate setting unit 22 sets the frame rate of the video image data, to be output to the display panel 4 from the timing generator 3, to the predetermined value and outputs a frame rate control signal to the timing generator 3. The frame rate control signal is a control signal for controlling the timing generator 3 to set the frame rate of the video image data to the predetermined value.

The duty ratio setting unit 23 sets the duty ratio of the display panel 4 to a predetermined value according to the frame rate set, to the predetermined value, by the frame rate setting unit 22. The duty ratio is the ratio with respect to a video image displayed on the display screen of the display panel 4, and more specifically, the ratio of an emission time of a video image to a display time of the video image. After the duty ratio setting unit 23 sets the duty ratio to the predetermined value, the duty ratio setting unit 23 outputs a duty ratio control signal to the timing generator 3. The duty ratio control signal is a control signal for controlling the timing generator 3 to adjust the duty ratio of the display panel 4 to the predetermined value.

The timing generator 3 is, for example, a so-called COG driver implemented, in a chip-on-glass (COG) manner, on a glass substrate of the display panel 4, and is configured to drive the display panel 4 according to an instruction given from the CPU 2. The timing generator 3 may not be a COG driver, but it may be, for example, a chip-on-film (COF) driver or a chip-on-plastic (COP) driver. For example, the timing generator 3 may be one function in the COG driver or one function in the CPU 2. The timing generator 3 stores the video image data transferred from the video image data transfer unit 21 of the CPU 2 in a not-shown memory. The memory continues to hold the display data until next updating of the video image is performed, in other words, the memory continues to hold the display data unless a change occurs in the content of the video image.

Based on the frame rate control signal received from the frame rate setting unit 22, the timing generator 3 reads the video image data from the memory and outputs the video image data to the display panel 4 at the predetermined frame rate. If a change in the content of the video image occurs (in other words, in a case where video image data is transferred from the video image data transfer unit 21), then, regardless of the frame rate, the timing generator 3 reads out video image data from the memory and outputs the read video image data to the display panel 4.

The timing generator 3 includes a duty ratio adjustment unit 31. Based on the duty ratio control signal received from the duty ratio setting unit 23, the timing generator 3 sets, by the duty ratio adjustment unit 31, the duty ratio of the display panel 4 to the predetermined value. After the duty ratio adjustment unit 31 adjusts she duty ratio to the predetermined value, the duty ratio adjustment unit 31 outputs a light emission control signal to the display panel 4. The light emission control signal is a control signal for controlling the display panel 4 to emit light at the predetermined value of the duty ratio.

The timing generator 3 also generates various timing signals and data signals (source signal data representing video images) for driving the display panel 4, and outputs these signals to the display panel 4.

Display Panel 4

The display panel 4 includes a display screen having a plurality of pixels, a source driver, a gate driver, and the like. The display panel 4 is, for example, an oxide semiconductor display panel configured as an active matrix type display panel. An oxide semiconductor display panel is a display panel in which an oxide semiconductor TFT (thin film transistor) is used as a switching element provided in correspondence with at least each one of a plurality of pixels arranged in a two dimensional manner. The oxide semiconductor-TFT is a TFT in which an oxide semiconductor is used to form a semiconductor layer. Examples of the oxide semiconductor include indium gallium zinc oxide semiconductors (InGaZnO-based oxide semiconductors).

The oxide semiconductor-TFT provides a high current in an on-state and has a low leakage current in an off-state. The oxide semiconductor-TFT has good switch-off characteristics such that when the switch is turned off, the amount of charge leakage is small and the charge retention characteristics are excellent. Therefore, by employing the oxide semiconductor-TFT as a switching element, it becomes possible to reduce the refresh rate of the video image displayed on the display screen of the display panel 4 to about 1 Hz. The reduction in the refresh rate provides a power-saving effect.

In each of the embodiments described below, it is assumed by way of example that an organic EL (electroluminescence) display element is used as the display element of each pixel. However, a display element other than the organic EL display element may be used. For example, in a case where the display panel 4 is a liquid crystal display panel, the display apparatus 10 includes a backlight disposed on the back of the display panel 4. That is, in the present description, "the emission of light in the display panel 4" is a concept that includes cases where the display panel 4 itself emirs light as well as cases where the display panel 4 emits light when a light emitting device such as a backlight emits light.

Hold Driving and Pseudo-Impulse Driving of Display Apparatus 10

Figure 3:
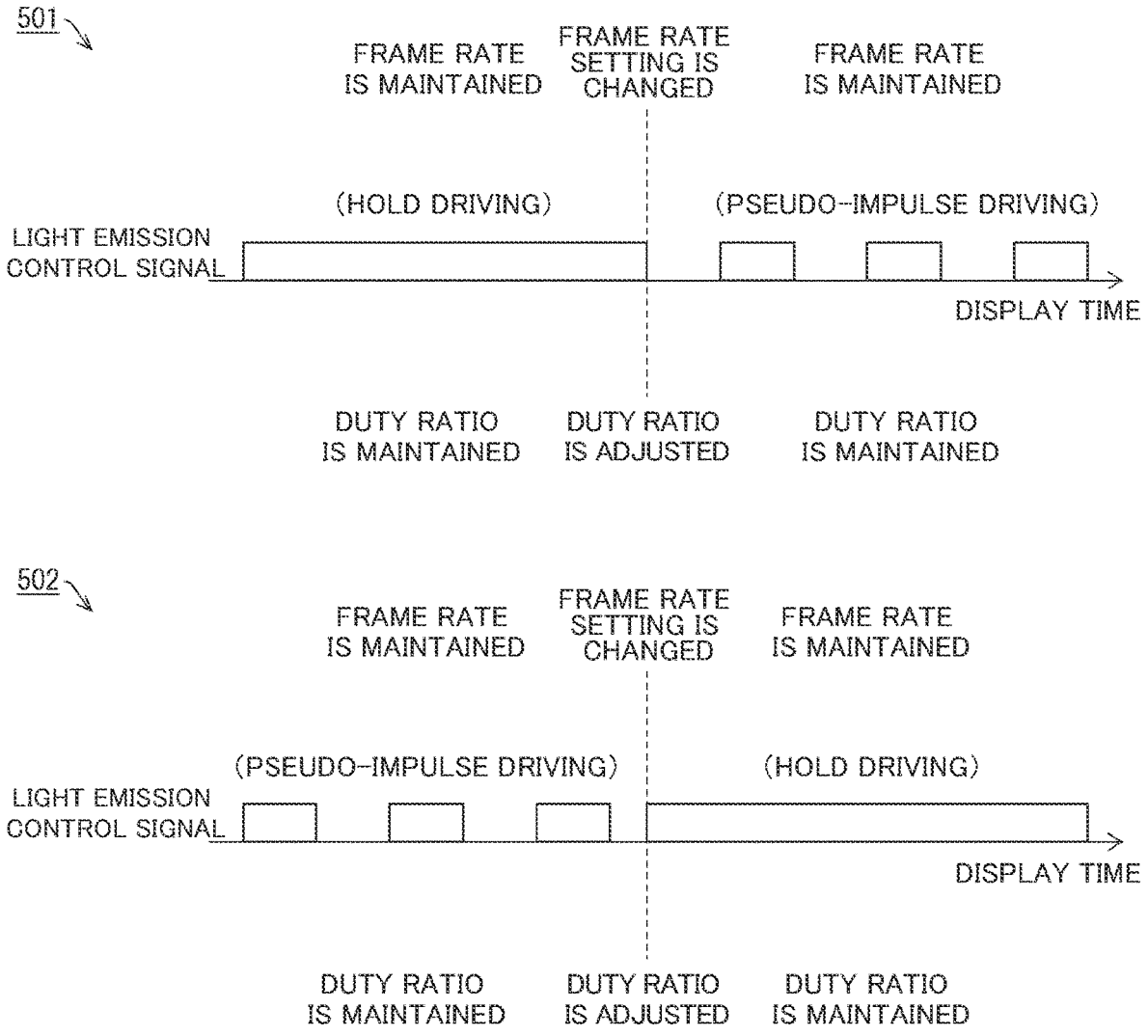
FIG. 3 is a timing chart illustrating an example of hold driving and an example of pseudo-impulse driving of a display apparatus according to the first embodiment of the present disclosure, wherein reference numeral 501 illustrates a timing chart in which switching occurs from the hold driving to the pseudo-impulse driving, while reference numeral 502 illustrates a timing chart in which switching occurs from the pseudo-impulse driving to the hold driving.

Referring to FIG. 3, hold driving and pseudo-impulse driving performed in the display apparatus 10 are described below. As shown in FIG. 3, the display apparatus 10 switches the light emission mode of the display panel 4 between the hold driving and the pseudo-impulse driving by adjusting, using the duty ratio adjustment unit 31 of the timing generator 3, the duty ratio of the display panel 4. In FIG. 3, reference numeral 501 shows an example in which the light emission mode of the display panel 4 is switched from the hold driving to the pseudo-impulse driving. In FIG. 3, reference numeral 502 shows an example in which the light emission mode of the display panel 4 is switched from the pseudo-impulse driving to the hold driving.

The hold driving is a light emission mode in which the display panel 4 continuously performs light emission over one frame period. In the present embodiment and in the embodiments described below, the duty ratio of the display panel 4 in the hold driving is set to at approximately 100%. This is because, strictly speaking, even in the hold driving, the display panel 4 has a short non-light-emission period. In the following description, for the sake of simplicity, "duty ratio of 100%" means that the duty ratio is approximately 100%. Note that "duty ratio of 100%" in the drawings also means that the duty ratio is approximately 100%.

The one frame period is a period during which a video image is displayed on the display panel 4 at a predetermined frame rate. The pseudo-impulse driving is a light emission mode of the display panel 4 in which the one frame period includes a non-light-emission period with a length set to be equal to or longer than a particular length in which the display panel 4 is in a non-light-emission state. The duty ratio of the display panel 4 in the pseudo-impulse driving may be arbitrarily adjusted to, for example, 50%, 70%, or the like, depending on the frame rate of the video image displayed on the display panel 4.

In the display apparatus 10, after the light emission mode of the display panel 4 is switched to the hold driving or the pseudo-impulse driving, the duty ratio adjustment unit 31 maintains the duty ratio at the value obtained after the light emission mode of the display panel 4 is switched thereby maintaining the switched light emission mode. The duty ratio adjustment unit 31 maintains the duty ratio at the value as of after the switching as long as the frame rate setting unit 22 maintains the frame rate at the value as of after the setting is changed. The switching and the maintaining of the light emission mode of the display panel 4 are both performed by the display panel 4 in response to receiving the light emission control signal from the duty ratio adjustment unit 31.

For example, in a case where when hold driving is being performed, the display apparatus 10 starts to execute, in foreground, an application program in which a video image is to be displayed with high display quality, the display apparatus 10 switches the light emission mode of the display panel 4 from the hold driving to the pseudo-impulse driving. For example, in a case where when pseudo-impulse driving is being performed, the display apparatus 10 starts to execute, in foreground, an application program in which a reduction of power consumption has a higher priority than achieving higher display quality, the display apparatus 10 switches the light emission mode of the display panel 4 from the pseudo-impulse driving to the hold driving.

Operation of Display Apparatus 10

Figures 4, 5:
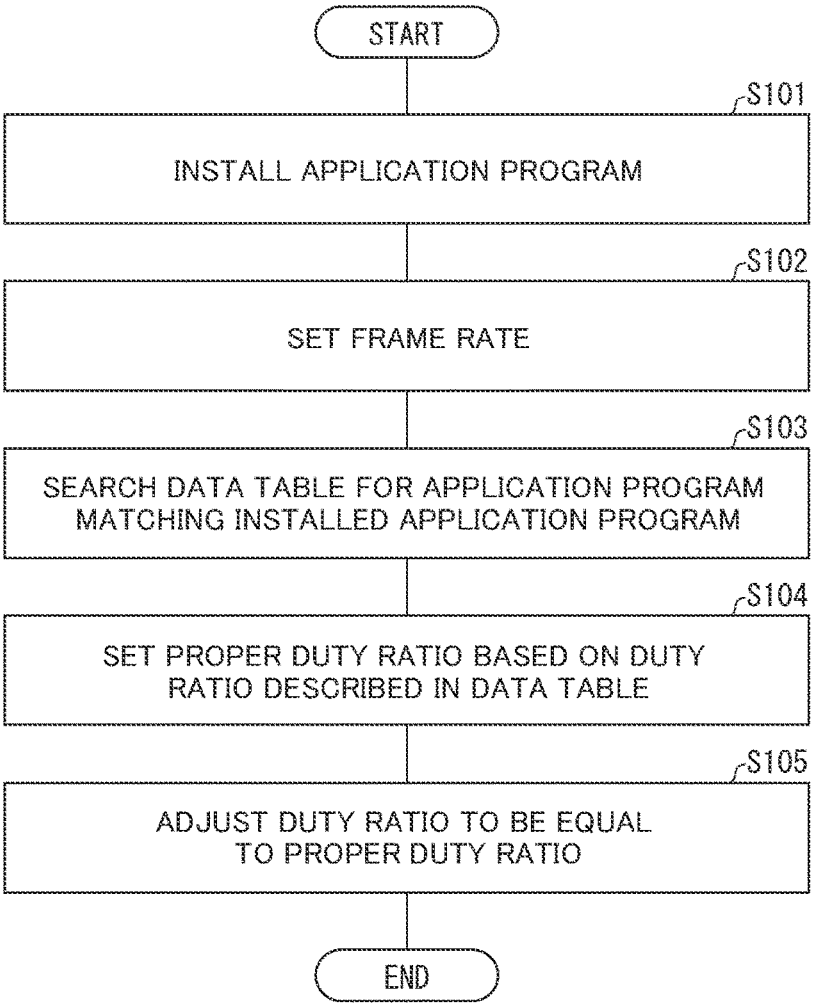
FIG. 4 is a flowchart illustrating a flow of an operation of the display apparatus according to the first embodiment of the present disclosure.
FIG. 5 is a diagram illustrating an example of a data table stored in a storage apparatus of a portable terminal according to the first embodiment of the present disclosure.
Figure 6:
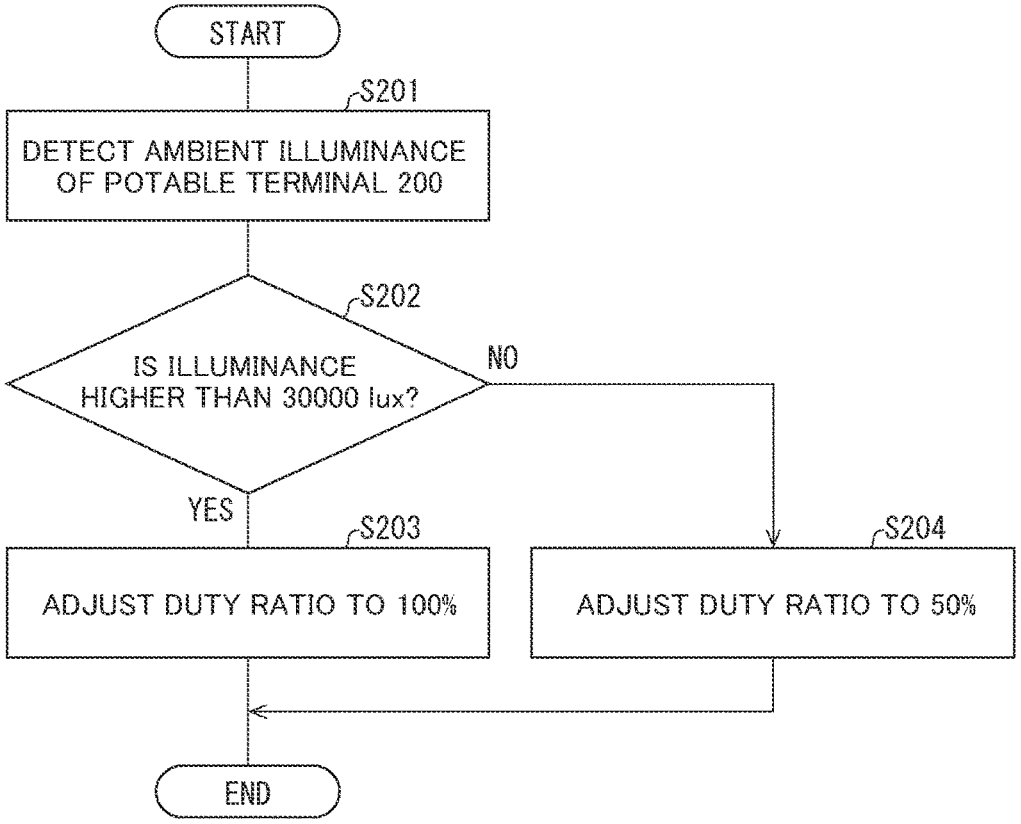
FIG. 6 is a flowchart illustrating a flow of an operation of the display apparatus according to the second embodiment of the present disclosure.

Referring to FIGS. 4 and 5, a flow of an operation of the display apparatus 10 is described below. In the present embodiment and the embodiments described below, it is assumed by way of example that the CPU 2 of the display control apparatus 1 acquires video image data generated by an application program that is started and executed in the display apparatus 10.

First, in step S101 (hereinafter "step" is omitted), the portable terminal 100 installs a particular application program via the communication apparatus 20. The installed application program include various kinds of information indicating a name, a content, and a category of the application program. The category information indicates a category, such as a game, news, etc., of the application program. The installed application program is stored once in the storage apparatus 30. When the display apparatus 10 reads the application program from the storage apparatus 30 and starts to execute the application program in the display apparatus 10, the process proceeds to S102.

In S102, the frame rate setting unit 22 of the CPU 2 sets the frame rate of the video image data output from the timing generator 3 to the display panel 4 to a predetermined value. More specifically, the frame rate setting unit 22 reads the frame rate information regarding the frame rate of the application program from the storage apparatus 30, and sets a frame rate value included in the frame rate information as the frame rate of the video image data.

Each time the value of the frame rate included in the frame rate information changes, the frame rate setting unit 22 accordingly changes the value of the frame rate of the video image data. In a data table, as described later, duty ratios are described for various applications programs, and the duty ratio of the installed application program is set to be equal to the duty ratio of the application program, described in the data table, identical to the installed application program. Therefore, each time the value of the frame rate included in the frame rate information changes, the value of an appropriate duty ratio, described below, is also changed. When the setting of the frame rate for the video image data by the frame rate setting unit 22 is completed, the process proceeds to S103.

In S103, the duty ratio setting unit 23 reads the data table such as that shown in FIG. 5 from the storage apparatus 30. In the data table shown in FIG. 5, application programs such as "1st application, 2nd application, 3rd application, 4th application, etc." are each described in association with a category, and a light emission mode of the display panel 4 (the hold driving or the pseudo-impulse driving).

In the present embodiment, the light emission mode of the display panel 4 is preset for each application program according to the category of the application program and stored in the data table. For example, in FIG. 5, the category is defined as "game" for the 1st and 4th application programs, and higher frame rates are set than for application programs of other categories. Therefore, for the "1st application program" and the "4th application program", the "pseudo-impulse driving" is designated as the light emission mode of the display panel 4 from the point of view of improving the display quality.

In the example shown in FIG. 5, the frame rate is lower in the "4th application program" than in the "1st application program" although not shown in the figure. Therefore, the duty ratio for the 1st application program is set to be smaller (50%) than the duty ratio (70%) set for the 4th application program because the 1st application program has a higher demand for improved display quality than the 4th application program.

On the other hand, in FIG. 5, the category of the 2nd application program is "productivity" and the category of the 3rd application program is "news". The frame rates set for the application programs of these categories are not high compared to the frame rates for the application programs of the category of "game" or the like. Therefore, in the "2nd application program" and the "3rd application program", reducing power consumption of the display apparatus 10 has a higher priority than achieving high display quality, and thus the light emission mode of the display panel 4 is set to the "hold driving".

The setting of the light emission mode of the display panel 4 in the data table is not limited to the above-described example according to the present embodiment. For example, a user may change the setting of the light emission mode of the display panel 4 set in the data table according to user's preference. In this case, the CPU 2 may accept inputting performed by a user, for example, via an input unit provided on the portable terminal 100, and may change a light emission mode of the display panel 4 set in the data table.

The setting of the light emission mode of the display panel 4 may not based on the information on the category of the application program. For example, the light emission mode of the display panel 4 may be set in the data table based on information on a content of an application program. That is, based on any information of an application program that allows it to presume or identify the frame rate of the application program, the light emission mode of the display panel 4 may be set in the data table.

When the duty ratio setting unit 23 reads the data table, the duty ratio setting unit 23 searches the data table to find therein an application program matching the application program installed on the portable terminal 100. More specifically, the duty ratio setting unit 23 reads information as to a name and a category of the installed application program from the storage apparatus 30 and searches the data table for the matched name and category. When the duty ratio setting unit 23 finds, in the data table, an application program that matches the installed application program, the process proceeds to S104.

In S104, the duty ratio setting unit 23 sets the duty ratio of the display panel 4 to the duty ratio of the application program in the data table that matches the installed application program. The step in S104 is an example of the setting step according to one aspect of the present disclosure. More specifically, as shown in FIG. 5, a duty ratio for a display panel 4 is described in the data table together with a light emission mode of the display panel 4. Therefore, if the duty ratio setting unit 23 finds, from the data table, an application program that matches the installed application program, the duty ratio setting unit 23 can automatically set the duty ratio of the display panel 4.

Thus, by setting the duty ratio of the display panel 4 in the above-described manner, the proper duty ratio is set. Note that in the data table, duty ratios are defined according to frame rates of the respective application programs. Therefore, the process of "setting the duty ratio of the display panel 4 according to a result of searching the data table for an application program matching the installed application program" by the duty ratio setting unit 23 is the process of setting the duty ratio of the display panel 4 according to the frame rate of the installed application program.

That is, as can be seen from the above discussion, the proper duty ratio is the duty ratio set according to the frame rate of video image data generated by the installed application program, in other words, according to the frame rate of video image data acquired by the CPU 2. More specifically, the proper duty ratio is set such that as the frame rate of a video image increases, the ratio of the emission time of the video image to the time of displaying the video image decreases, and as the frame rate of the video image decreases, the ratio of the emission time of the video image to the time of displaying the video image increases. The duty ratio setting unit 23 outputs a duty ratio control signal to the tiding generator 3. Thereafter, the process proceeds to S105.

In S105, upon receiving the duty ratio control signal, the duty ratio adjustment unit 31 of the timing generator 3 adjusts the duty ratio of the display panel 4 to the predetermined value, in other words, to the proper duty ratio. The step in S105 is an example of the adjustment according to one aspect of the present disclosure, when the process in S105 is completed, the series of processing of the display apparatus 10 is ended.

A purpose of the display apparatus 10 is to display video images generated by a game application program or the like with a high frame rate with high display quality. To achieve this purpose, the CPU 2 of the display control apparatus 1 may determine the proper duty ratio such that as the frame rate of a video image increases, the ratio of the emission time of the video image to the display time of the video image decreases. In other words, even in a case where the frame rate of a video image is low, the CPU 2 may not set the proper duty ratio such that the ratio of the emission time of the video image to the display time of the video image is high.

In the display apparatus 10, not only for the above-described game application programs according to the present embodiment, but also, for example, for some application programs (other than game application programs) set by a user, the CPU 2 may set the proper duty ratio. More specifically, the CPU 2 may also set the proper duty ratio for the some application programs such that as the frame rate of a video image increases, the ratio of the emission time of the video image to the display time of the video image decreases. In this way, also for some application programs, it is possible to display the video image generated at a high frame rate such that the displayed image has high display quality.

Furthermore, also for a tool in which scrolling is used in many situations (for example, in a settings menu or the like), the CPU 2 may set the proper duty ratio such that as the frame rate of a video image increases, the ratio of the emission time of the video image to the display time of the video image decreases. In this way, also for the tool in which scrolling is performed in many situations, it is possible to display the video image in the tool so as to have high display quality.

Note that in the display apparatus 10, depending on application programs, the CPU 2 may not reduce the ratio of the emission time of a video image to the display time of the video image even in a state in which the frame rate is high. For example, CPU 2 may set the proper duty ratio to 100% (hold driving) even at a high frame rate. A homepage application program is an example of an application program in which the duty ratio may be adjusted in the above-described manner.

Second Embodiment

Outline of Configurations of Portable Terminal 200 and Display Apparatus 10*a*

Referring to FIG. 1, an outline of a configuration of a portable terminal 200 according to a second embodiment of the present disclosure is described. Furthermore, referring to FIG. 2, an outline of a configuration of a display apparatus 10*a* according to the second embodiment of the present disclosure is described. The portable terminal 200 is different from the portable terminal 100 according to the first embodiment of the present disclosure and different a portable terminal 300 according to a third embodiment of the present disclosure in that the portable terminal 200 includes an illuminance sensor 40 shown in FIG. 1.

The illuminance sensor 40 is an apparatus configured to detect the ambient illuminance of the portable terminal 200 and is an example of an illuminance detection unit according to one aspect of the present disclosure. The illuminance sensor 40 may not be embedded in the portable terminal 200 but may be installed outside the portable terminal 200. In a case where the illuminance detection unit according to one aspect of the present disclosure is provided outside the portable terminal 200, for example, an illuminometer including a communication apparatus may be provided instead of the illuminance sensor 40. In this case, data associated with the ambient illuminance of the portable terminal 200 measured by the illuminometer is transmitted from the communication apparatus of the illuminometer to the communication apparatus 20 of the portable terminal 200 such that the portable terminal 200 acquires the data associated with the illuminance.

A camera may be used instead of the illuminance sensor 40 as the illuminance detection unit according to one aspect of present disclosure. In this case, the camera detects the ambient illuminance of the portable terminal 200 by detecting the exposure. The camera may be disposed in the portable terminal 200 or may be provided outside the portable terminal 200.

The display apparatus 10*a* is different from the display apparatus 10 according to the first embodiment of the present disclosure and different from a display apparatus 10*b* according to the third embodiment of the present disclosure in that the display apparatus 10*a* includes an display control apparatus 1*a* shown in FIG. 2 instead of the display control apparatus 1. The display control apparatus 1*a* is different from the display control apparatus 1 according to the first embodiment of the present disclosure and different from a display control apparatus 1*b* according to the third embodiment of the present disclosure in that the CPU 2 includes an illuminance comparison unit 24 shown in FIG. 2.

The illuminance comparison unit 24 compares the ambient illuminance of the portable terminal 200 detected by the illuminance sensor 40 with the reference illuminance. The reference illuminance is an illuminance that is used as a reference for determining whether or not to adjust the duty ratio of the display panel 4. For example, the reference illuminance may be arbitrarily set depending on the illuminance of an environment in which the portable terminal 200 is used. The reference illuminance is stored in advance in the storage apparatus 30 or a host memory of the CPU 2. The illuminance comparison unit 24 outputs a comparison result to the duty ratio setting unit 23.

The duty ratio setting unit 23 sets the proper duty ratio, and further sets or maintains the duty ratio of the display panel 4 depending on the received comparison results. After the duty ratio setting unit 23 sets or maintains the duty ratio of the display panel 4 according to the comparison result, the duty ratio setting unit 23 outputs a duty ratio control signal to the timing generator 3.

Upon receiving the duty ratio control signal, the duty ratio adjustment unit 31 of the timing generator 3 adjusts the duty ratio of the display panel 4 such that the duty ratio of the display panel 4 becomes equal to the duty ratio set or maintained by the duty ratio setting unit 23 according to the comparison result.

Operation of Display Apparatus 10*a*

Referring to FIGS. 6 to 9, a flow of an operation of the display apparatus 10*a* is described below. The following description of this embodiment is given by way of example for a case where the reference illuminance is set at 30000 [lux] (assuming a cloudy outdoor environment in which the portable terminal 200 is used).

First, in S201, the illuminance sensor 40 detects the ambient illuminance of the portable terminal 200. The illuminance sensor 40 outputs a detection result to the illuminance comparison unit 24 of the CPU 2. Thereafter, the process proceeds to S202. In S202, upon receiving the detection result, the illuminance comparison unit 24 reads the reference illuminance (30000 [lux]) from the storage apparatus 30 or the host memory of the CPU 2. The illuminance comparison unit 24 compares the detection result with the read reference illuminance and determines whether or not the detection result is higher than the reference illuminance.

In a case where the detection result is higher than the reference illuminance, that is, in a case where YES in S202, the process proceed to S203. In S203, upon receiving the comparison result indicating that the detection result exceeds the reference illuminance, the duty ratio setting unit 23 sets the duty ratio of the display panel 4 to 100% and outputs a duty ratio control signal to the timing generator 3. Upon receiving the duty ratio control signal, the duty ratio adjustment unit 31 of the timing generator 3 adjusts the duty ratio of the display panel 4 to 100% according to the received duty ratio control signal.

Figure 7:
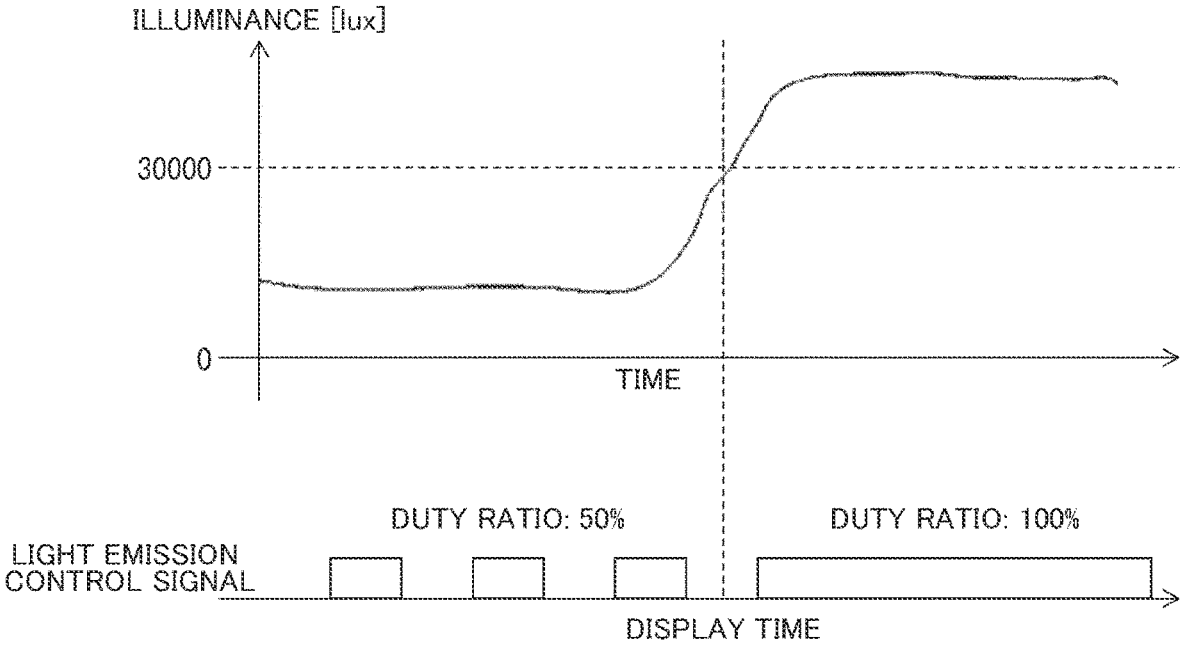
FIG. 7 illustrates an example of a graph and a timing chart associated with an adjustment of a duty ratio in the display apparatus according to the second embodiment of the present disclosure.

For example, as shown in FIG. 7, in a case where the duty ratio of the display panel 4 is 50% before the adjustment is performed by the duty ratio adjustment unit 31, the display apparatus 10*a* maintains the duty ratio of the display panel 4 at 50% unless the ambient illuminance of the portable terminal 200 exceeds the reference illuminance. When the ambient illuminance of the portable terminal 200 exceeds the reference illuminance, the display apparatus 10*a* switches the duty ratio of the display panel 4 from 50% to 100%.

On the other hand, in a case where the detection result is equal to or lower than the reference illuminance, in other words, in a case where NO in S202, the process proceeds to S204. In S204, upon receiving comparison result indicating that the detection result is equal to or lower than the reference illuminance, the duty ratio setting unit 23 sets the duty ratio of the display panel 4 to 50% and outputs a duty ratio control signal to the timing generator 3. Upon receiving the duty ratio control signal, the duty ratio adjustment unit 31 adjusts the duty ratio of the display panel 4 to 50% according to the received duty ratio control signal.

Figure 8:
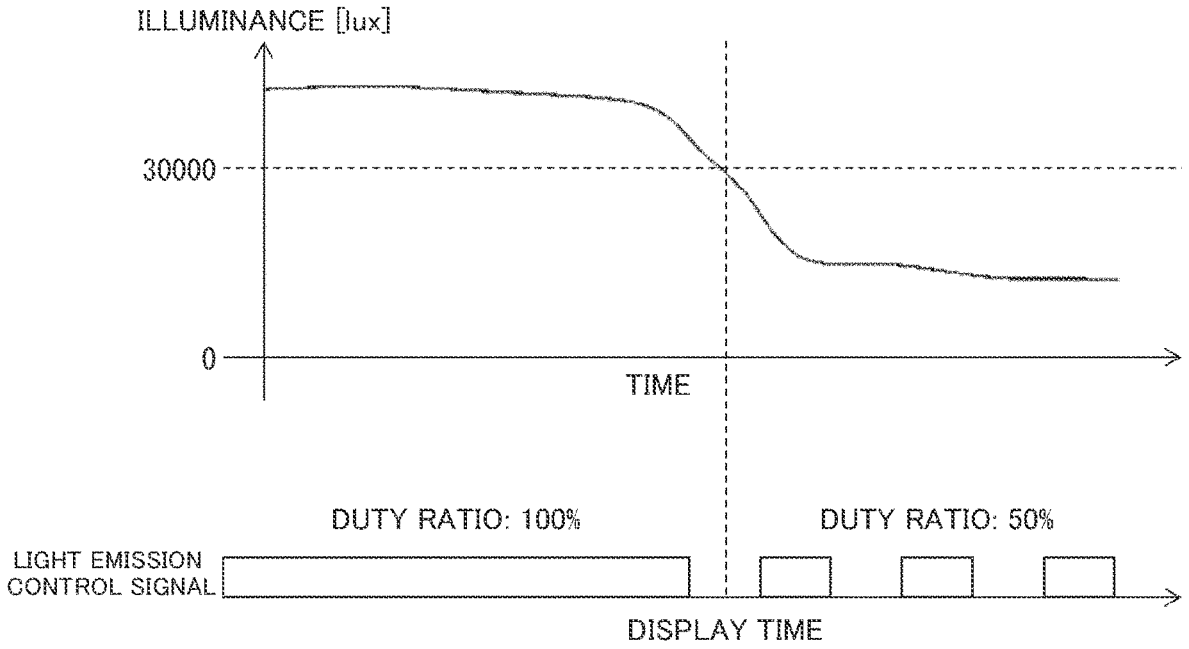
FIG. 8 illustrates another example of a graph and a timing chart associated with an adjustment of a duty ratio in the display apparatus according to the second embodiment of the present disclosure.

For example, as shown in FIG. 8, in a case where the duty ratio of the display panel 4 is 100% before the adjustment is performed by the duty ratio adjustment unit 31, the display apparatus 10*a* maintains the duty ratio of the display panel 4 at 100% unless the ambient illuminance of the portable terminal 200 decreases to an illuminance value equal to or lower than the reference illuminance. When the ambient illuminance of the portable terminal 200 decreases to a level equal to or lower than the reference illuminance, the display apparatus 10*a* switches the duty ratio of the display panel 4 from 100% to 50%.

The adjustment of the duty ratio of the display panel 4 in response to the result of the comparison of the ambient illuminance of the portable terminal 200 with respect to the reference illuminance is not limited to the switching between 50% and 100%. The values before and after switching the duty ratio of the display panel 4 can be set arbitrarily, when the process in S203 or S204 is completed, the series of processing of the display apparatus 10*a* is ended.

Modifications

The display apparatus 10*a* may set a plurality of reference illuminances and may discretely adjust the duty ratio of the display panel 4 to one of values of the reference illuminances. For example, as shown in FIG. 9, a first reference illuminance (30000 [lux]) and a second reference illuminance (40000 [lux]) are set, and the duty ratio of the display panel 4 may be adjusted at one of two levels depending on the illuminance.

Figure 9:
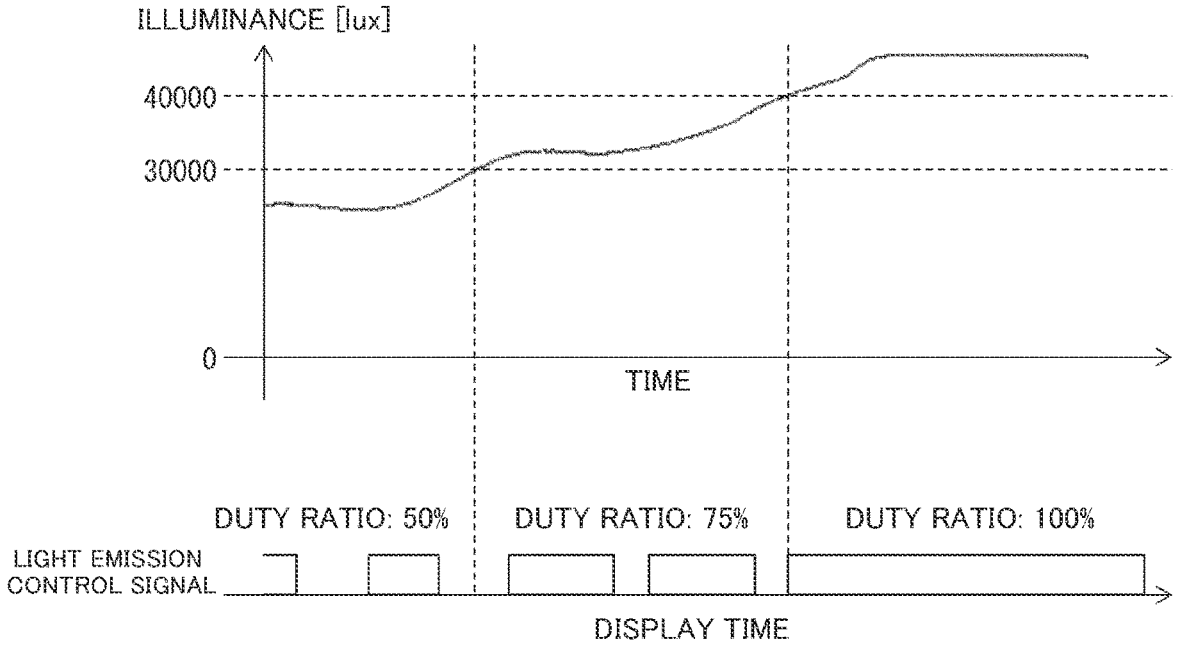
FIG. 9 illustrates an example of a graph and a timing chart associated with a modification of an adjustment of a duty ratio in the display apparatus according to the second embodiment of the present disclosure.

For example, as shown in FIG. 9, in a case where the duty ratio of the display panel 4 is 50% before the adjustment is performed by the duty ratio adjustment unit 31, the display apparatus 10*a* maintains the duty ratio of the display panel 4 at 50% unless the ambient illuminance of the portable terminal 200 exceeds a first reference illuminance. When the ambient illuminance of the portable terminal 200 exceeds the first reference illuminance, the display apparatus 10*a* (more specifically, the duty ratio adjustment unit 31) switches the duty ratio of the display panel 4 from 50% to 75%.

In a case where the duty ratio of the display panel 4 is switched to 75%, the display apparatus 10*a* maintains the duty ratio at 75% unless the ambient illuminance of the portable terminal 200 further exceeds the second reference illuminance or decreases to be lower than the first reference illuminance, when the ambient illuminance of the portable terminal 200 exceeds the second reference illuminance, the display apparatus 10*a* switches the duty ratio of the display panel 4 from 75% to 100%.

Third Embodiment

Figure 10:
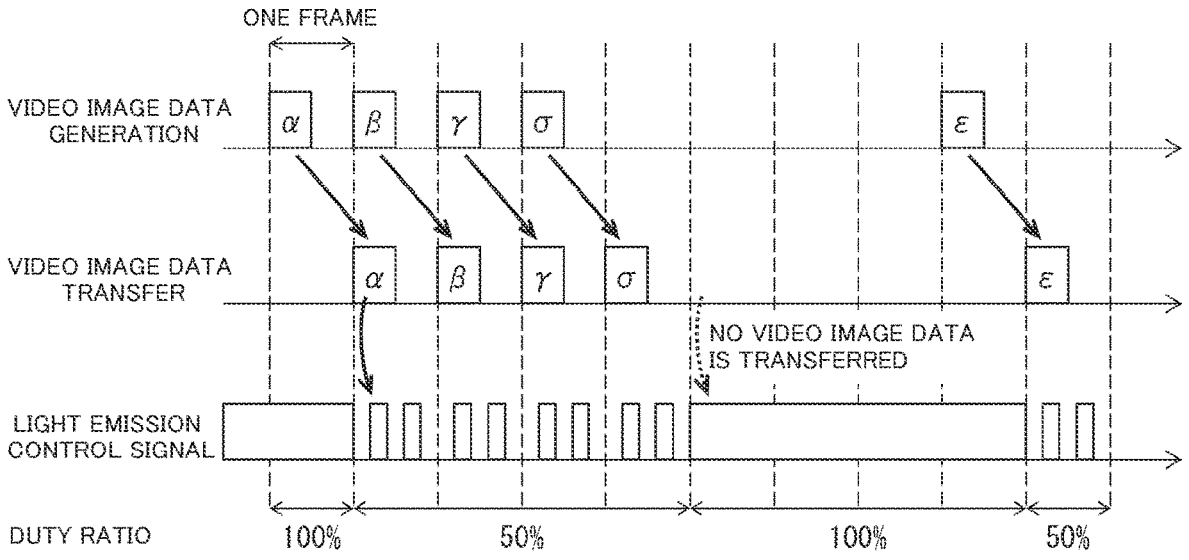
FIG. 10 is a timing chart illustrating a flow of an operation of the display apparatus according to the third embodiment of the present disclosure.

Referring to FIG. 10, an overview of an operation and an outline of a flow of the operation of the display apparatus 10*b* in accordance with a third embodiment of the present disclosure are described below. In this third embodiment of the present disclosure, a portable terminal 300, the display apparatus 10*b*, and a display control apparatus 1*b* each have a configuration similar to configurations of the portable terminal 100, the display apparatus 10, and the display control apparatus 1, respectively, according to the first embodiment of the present disclosure.

Overview of Operation of Display Apparatus 10*b*

The display apparatus 10*b* is different from the display apparatuses 10 and 10*a* in that the CPU 2 of the display control apparatus 1*b* controls the timing generator 3 to adjust the duty ratio of the display panel 4 according to whether or not video image data is transferred. In the present embodiment, it is assumed that the display apparatus 10*b* performs the adjustment of the duty ratio of the display panel 4 according to whether video image data is transferred or not, together with the adjustment to the proper duty ratio (see the first embodiment). However, the adjustment of the duty ratio by the display apparatus 10*b* is not limited to that in the above-described manner. The adjustment of the duty ratio by the display apparatus 10*b* may performed, for example, such that in addition to the two adjustments described above, an adjustment may be performed as to the duty ratio of the display panel 4 according to the result of the comparison of the ambient illuminance of the portable terminal 300 with the reference illuminance (see the second embodiment).

More specifically, in a case where the video image data transfer unit 21 of the CPU 2 does not transfer video image data to the timing generator 3, the duty ratio setting unit 23 of the CPU 2 sets the duty ratio of the display panel 4 such that the display panel 4 continuously perform light emission over a whole period in which the video image data is not transferred. In other words, the duty ratio setting unit 23 sets the duty ratio of the display panel 4 to 100% over a whole period in which the video image data transfer unit 21 does not transfer the video image data.

When the duty ratio setting unit 23 sets the duty ratio of the display panel 4 to 100%, the duty ratio setting unit 23 outputs a duty ratio control signal to the timing generator 3. Upon receiving the duty ratio control signal, the duty ratio adjustment unit 31 of the timing generator 3 adjusts the duty ratio of the display panel 4 to 100%.

On the other hand, in a case where the video image data transfer unit 21 transfers video image data to the timing generator 3, the duty ratio setting unit 23 sets the duty ratio of the display panel 4 such that the display panel 4 has at least one period during the period in which the video image data is transferred. In the following explanation of the present embodiment, it is assumed, by way of example, as shown in FIG. 10, that the duty ratio setting unit 23 sets the duty ratio of the display panel 4 to 50% during a period in which transferring of video image data is performed.

When the duty ratio setting unit 23 sets the duty ratio of the display panel 4 to 50%, the duty ratio setting unit 23 outputs a duty ratio control signal to the timing generator 3. Upon receiving the duty ratio control signal, the duty ratio adjustment unit 31 of the timing generator 3 adjusts the duty ratio of the display panel 4 to 50%.

Flow of Operation of Display Apparatus 10*b*

As shown in FIG. 10, when video image data α, β, γ and δ are sequentially generated by an application program which is started and executed in the display apparatus 10*b*, the CPU 2 sequentially acquires these pieces of video image data. The video image data transfer unit 21 sequentially transfers, on a frame-by-frame basis, these pieces of video image data α, β, γ and δ to the timing generator 3.

The duty ratio setting unit 23 sets the duty ratio of the display panel 4 to 50% over a period in which the video image data transfer unit 21 transfers the video image data α, β, γ and δ. A flow a subsequent operation of the duty ratio setting unit 23 and that of the duty ratio adjustment unit 31 are similar to those described above.

If the above-described application program generates no video image data for a certain period after video image data δ, the CPU 2 acquires no video image data and the video image data transfer unit 21 transfers no video image data. The duty ratio setting unit 23 sets the duty ratio of the display panel 4 to 100% over the certain period in which the video image data transfer unit 21 transfers no video image data. A flow a subsequent operation of the duty ratio setting unit 23 and that of the duty ratio adjustment unit 31 are similar to those described above.

In a case where the above-described application program generates video image data ε when the certain period has elapsed after the generation of the video image data δ, the CPU 2 acquires the video image data ε. The video image data transfer unit 21 transfers the video image data ε to the timing generator 3. Since the video image data transfer unit 21 has resumed transferring of video image data, the duty ratio setting unit 23 again sets the duty ratio of the display panel 4 to 50%. A flow a subsequent operation of the duty ratio setting unit 23 and that of the duty ratio adjustment unit 31 are similar to those described above.

Examples of Implementation by Software

Control blocks (in particular, the CPU 2 and the timing generator 3) of the display control apparatuses 1, 1*a*, and 1*b* may be realized by Logic circuits (hardware) formed in an integrated circuit (an IC chip) or the like, or may be realized by software.

In the latter case, the display control apparatuses 1, 1*a* and 1*b* each include a computer that executes instructions of a computer program, which is software that realizes a function. The computer includes at least one processor (a control apparatus) or the like and at least one computer-readable storage medium in which the program is stored. In the computer, the processor reads the program from the storage medium and executes the program, thereby accomplishing an aspect of the present disclosure.

For example, a CPU may be used as the processor. The storage medium may be a "non-transitory tangible medium", such as a read-only memory (ROM), a tape, a disk, a card, a semiconductor memory, a programmable logic circuit, or the like. A RAM (Random Access Memory) or the like for loading the program may also be provided. Alternatively, the program may be supplied to the computer via a transmission medium (a communication network, a broadcast wave, or the like) capable of transmitting the program. Note that an aspect of the present disclosure may also be realized in the form of a data signal embedded in a carrier wave such that the program is embodied by electronic transmission.

Summary of Embodiments

According to a first aspect, the present disclosure provides a display control apparatus (1, 1*a*, 1*b*) configured to control a display apparatus (10, 10*a*, 10*b*) including a display panel (4), including a host control unit (a CPU 2) configured to acquire or generate video image data (α, β, γ, δ, ε) of a video image to be displayed on the display panel, and a display control unit (a timing generator 3) configured to output the video image data transferred from the host control unit to the display panel, the host control unit performing setting a proper duty ratio of a duty ratio indicating a ratio of a light emission time of the video image to a display time of the video image such that as a frame rate of the video image increases, the ratio of the light emission time of the video image to the display time of the video image decreases, and controlling the display control unit to adjust the duty ratio such that the display panel emits light at the proper duty ratio.

In this display control apparatus configured in the above-described manner, the host control unit can determine the proper duty ratio such that as the frame rate of the video image increases, the ratio of the emission time of the video image to the display time of the video image decreases. Therefore, a display blur and an after-image effect can be reduced when the display apparatus operates with high display quality as in a case where a game application program, in which a video image is to be displayed at a higher frame rate than in other application programs, is executed.

Aspect 2 of the present disclosure provides a display control apparatus, based on Aspect 1, in which the host control unit may determine the proper duty ratio such that as the frame rate of the video image decreases, the ratio of the emission time of the video image to the display time of the video image increases.

In this display control apparatus configured in the above-described manner, the host control unit can determine the proper duty ratio such that as the frame rate of a video image decreases, the ratio of the emission time of the video image to the display time of the video image increases. Therefore, in a case where a display blur or an after-image effect is not much of a problem, it is allowed to reduce the power consumption of the display apparatus, and it is allowed to reduce the load on the display apparatus thereby reducing its degradation with time.

Aspect 3 of the present disclosure provides a display control apparatus (1*a*), based on Aspect 1 or 2, in which the host control unit may further perform comparing an ambient illuminance of the display apparatus (10*a*) detected by the illuminance detection unit (illuminance sensor 40) with a reference illuminance, and controlling the display control unit to adjust the duty ratio according to a comparison result.

In this display control apparatus configured in the above-described manner, the host control unit can control the display control unit to adjust the duty ratio such that when the ambient illuminance of the display apparatus is higher than the reference illuminance, the ratio of the emission time of the video image to the display time of the video image is increased to be higher than before the adjustment. This maxes it possible to increase the display illuminance of the display apparatus to achieve high visibility in an environment in which achieving high visibility of the display apparatus is more important than reducing a display blur or an after-image effect as in a case where the display apparatus is used outdoors.

The host control unit also can control the display control unit to adjust the duty ratio such that when the ambient illuminance of the display apparatus is equal to or lower than the reference illuminance, the ratio of the emission time of the video image to the display time of the video image is reduced to be lower than before the adjustment. This makes it possible to reduce the duty ratio of the display apparatus to be lower than before the adjustment so as to reduce the display blur in an environment in which reducing a display blur or an after-image effect is more important than achieving high visibility of the display apparatus as in a case where the display apparatus is used indoors. As described above, regardless of the ambient illuminance of the display apparatus, it is possible to improve the display quality of the display apparatus.

Aspect 4 of the present disclosure provides a display control apparatus, based on Aspect 3, in which the host control unit may control the display control unit to adjust the duty ratio such that when the ambient illuminance of the display apparatus is higher than the reference illuminance, the display panel continues emission of light over one frame period in which the video image is displayed at the predetermined frame rate.

In this display control apparatus configured in the above-described manner, the host control unit is capable of increasing the display illuminance of the display panel to be higher than in a case where the display panel has a non-light-emission period with a length equal to or larger than a particular value in an environment, in which achieving high visibility of the display apparatus is more important than reducing a display blur or an after-image effect. Thus, even in the environment described above, it is possible to achieve high visibility of the display apparatus.

Aspect 5 of the present disclosure provides a display control apparatus (1*b*), based on one of Aspects 1 to 4, in which the host control unit may control the display control unit to adjust the duty ratio such that in a case where the video image data is not transferred to the display control unit, the display panel continues emission of light over a period in which the video image data is not transferred, while in a case where the video image data is transferred to the display control unit, the period in which the video image data is transferred includes at least one period during which the display panel does not emit light.

In this display control apparatus configured in the above-described manner, the host control unit is capable of reducing power consumption of the display apparatus and degradation with time during a period in which no video image data is transferred to the display control unit. Furthermore, it is possible to improve the display quality of the display apparatus during a period in which video image data is transferred to the display control unit.

Aspect 6 of the present disclosure provides a display apparatus (10, 10*a*, 10*b*) including the display control apparatus (1, 1*a*, 1*b*) according to one of Aspects 1 to 5. In this display apparatus configured in the above-described manner, it is possible to achieve the display apparatus having effects similar to those of the display control apparatus according to Aspect 1 of the present disclosure.

Aspect 7 of the present disclosure provides a method of controlling a display control apparatus (1, 1*a*, 1*b*) configured to control a display apparatus (10, 10*a*, 10*b*) including a display panel (4), the display control apparatus including a host control unit (a CPU 2) configured to acquire or generate video image data (α, β, γ, δ, ε) of a video image to be displayed on the display panel, and a display control unit (a timing generator 3) configured to output the video image data transferred from the host control unit to the display panel, the method including (in S104) controlling the host control unit to adjust a proper duty ratio of a duty ratio indicating a ratio of a light emission time of the video image to a display time of the video image such that as a frame rate of the video image increases, the ratio of the light emission time of the video image to the display time of the video image decreases, and (in S105) controlling the display control unit to adjust the duty ratio such that the display panel emits light at the proper duty ratio. In this control method configured in the above-described manner, it is possible to achieve the control method that provides effects similar to those of the display control apparatus according to Aspect 1 of the present disclosure.

The display control apparatus according to any one of Aspects of present disclosure may be realized by a computer. In this case, a control program that causes the computer to operate as various units (software elements) of the display control apparatus thereby realizing the display control apparatus on the comparer, and a computer-readable storage medium in which the control program is stored also fall within the scope of an aspect of the present disclosure.

Notes

Note that the present disclosure is not limited to embodiments described above, and various modifications are possible within the scope described in claims. Embodiments obtained by combining the technical means disclosed in the embodiments also fall within the technical scope of the present disclosure. A new technical feature may be achieved by combining technical means disclosed in the embodiments.

While there have been described what are at present considered to be certain embodiments of the invention, it will be understood that various modifications may be made thereto, and it is intended that the appended claims cover all such modifications as fail within the true spirit and scope of the invention.

The present disclosure contains subject matter related to that disclosed in Japanese Priority Patent Application JP 2020-009380 filed in the Japan Patent Office on Jan. 23, 2020, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display control apparatus configured to control a display apparatus including a display panel, the display control apparatus comprising:

a host control unit configured to acquire or generate video image data of a video image to be displayed on the display panel; and a display control unit configured to output the video image data transferred from the host control unit to the display panel, the host control unit performing:

determining a proper duty ratio of a duty ratio indicating a ratio of a light emission time of the video image to a display time of the video image such that as a frame rate of the video image increases, the ratio of the light emission time of the video image to the display time of the video image decreases; and controlling the display control unit to adjust the duty ratio such that the display panel emits light at the proper duty ratio.

2. The display control apparatus according to claim 1, wherein the host control unit determines the proper duty ratio such that as the frame rate of the video image decreases, the ratio of the light emission time of the video image to the display time of the video image increases.

3. The display control apparatus according to claim 1, wherein the host control unit further performs comparing an ambient illuminance of the display apparatus detected by the illuminance detection unit with a reference illuminance, and controlling the display control unit to adjust the duty ratio according to a comparison result.

4. The display control apparatus according to claim 3, wherein the host control unit controls the display control unit to adjust the duty ratio such that when the ambient illuminance of the display apparatus is higher than the reference illuminance, the display panel continues emission of light over one frame period in which the video image is displayed at the predetermined frame rate.

5. The display control apparatus according to claim 1, wherein the host control unit further performs controlling the display control unit to adjust the duty ratio such that in a case where the video image data is not transferred to the display control unit, the display panel continues emission of light over a period in which the video image data is not transferred, while in a case where the video image data is transferred to the display control unit, the period in which the video image data is transferred includes at least one period during which the display panel does not emit light.

6. A display apparatus including the display control apparatus according to claim 1.

7. A computer-readable non-transitory storage medium storing a control program for causing a computer to function as the display control apparatus according to claim 1, wherein the computer functions as the host control unit and the display control unit.

8. A method of controlling a display control apparatus configured to control a display apparatus including a display panel, the display control apparatus comprising:

a host control unit configured to acquire or generate video image data of a video image to be displayed on the display panel; and a display control unit configured to output the video image data transferred from the host control unit to the display panel, the method comprising:

controlling the host control unit to adjust a proper duty ratio of a duty ratio indicating a ratio of a light emission time of the video image to a display time of the video image such that as a frame rate of the video image increases, the ratio of the light emission time of the video image to the display time of the video image decreases; and controlling the display control unit to adjust the duty ratio such that the display panel emits light at the proper duty ratio.

* * * * *